US005865005A

United States Patent [19]

Cataldo

[11] Patent Number: 5,865,005

[45] Date of Patent: Feb. 2, 1999

[54] PREFABRICATED CONCRETE RETAINING WALL

[76] Inventor: Michael A. Cataldo, 54545 Foss, Mt. Clemens, Mich. 48042

[21] Appl. No.: 908,146

[22] Filed: Aug. 6, 1997

[51] Int. Cl.[6] ..... E04B 5/04

[52] U.S. Cl. ..... 52/598; 405/284; 405/286

[58] Field of Search ..... 52/596, 598, 603, 52/612, 599, 604, 434; 405/258, 272, 284, 286

[56] References Cited

U.S. PATENT DOCUMENTS 4,884,921 12/1989 Smith ..... 405/286
4,990,032 2/1991 Smith ..... 405/286

*Primary Examiner*—Creighton Smith

*Attorney, Agent, or Firm*—Vanophem Meehan & Vanophem, P.C.

[57] ABSTRACT

A modular retaining wall composed of prefabricated concrete elements incorporating a panel with rearwardly extending legs, and a method of constructing the modular retaining wall in a straight or drafted configuration. The rearwardly extending legs have holes that can be used for lifting and moving the individual elements. The holes can also be used for attaching mechanical elements that anchor the panel to the earth if the conditions of the slope require the retaining wall to be reinforced and anchored. The holes are in the legs, and not on the panel. Therefore, the integrity of the panel remains structurally sound and is not compromised, improving the overall stability of the wall. All that is required to produce a drafted wall is to rearrange the positioning of the panel with respect to the ground under the wall.

9 Claims, 3 Drawing Sheets

FIG - 5
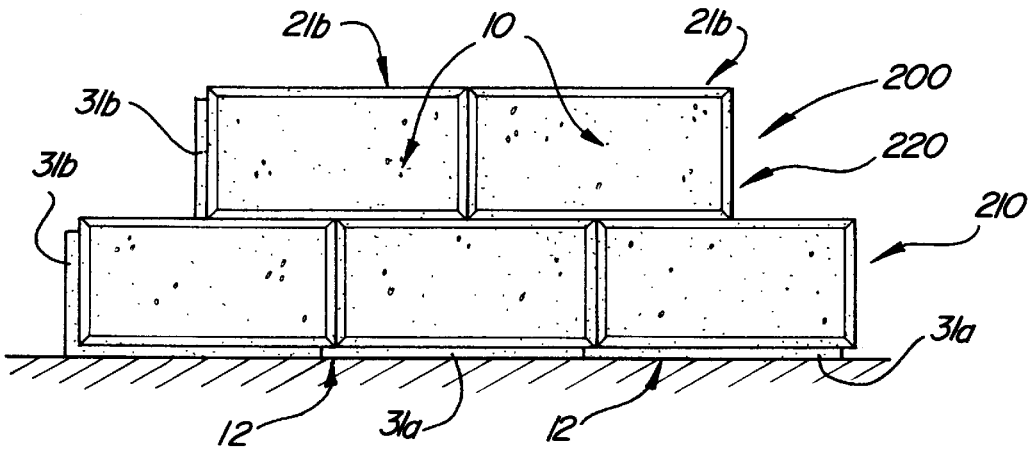
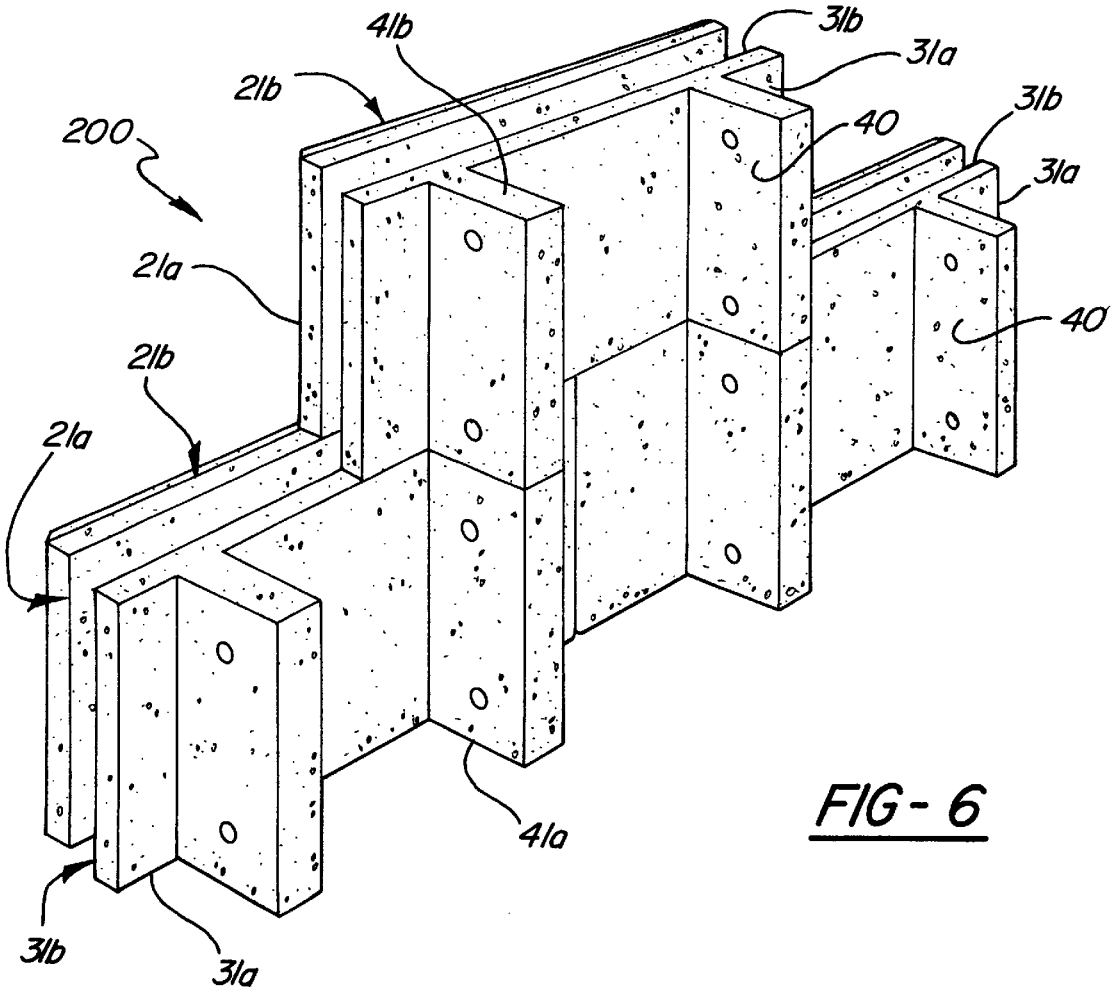
FIG - 6

PREFABRICATED CONCRETE RETAINING WALL

BACKGROUND OF INVENTION

1. Field of Invention

This invention relates to retaining wall in particular, to retaining walls constructed of prefabricated modular elements that support a natural or man-made slope.

2. Description of Prior Art

It is desirable in certain excavations to provide support for a natural or excavated slope to prevent its collapse. In practice, retaining walls are used to support, protect and stabilize slopes. Many factors enter into the engineering of a retaining wall based on the conditions of a particular slope, the load demands of the wall, and the wall's dimensions. In the past, retaining wall installation was time consuming and expensive. Prior art retaining walls begin with skeletal elements, usually made of metal, that are installed in the slope. Secondary operations are necessary to complete the wall, for example applying concrete surrounding the skeletal elements.

It is known in the art to create a wall using tiles having outwardly projecting flanges to improve the wall's resistance to rain, ice, snow and fire. U.S. Pat. No. 368,387 to Donaldson discloses a weather boarding or siding comprised of individual rectangular tiles having outwardly-projecting flanges or ledges arranged on opposite sides of the tile. The lower edge of the flange has a series of perforations and is secured to a frame of a house or other structure by nails or screws inserted through the perforations. The flange of an adjoining tile covers the flange having attaching means, concealing the fasteners from view.

The flange along the upper edge of the tile is beveled in one direction. The flange along the lower edge of the tile is beveled in the reverse direction. Thus when adjoining tiles are connected, the flanges overlap one another and the beveled edges form a dovetailed joint. This beveled flange arrangement is required to connect the adjoining edges of the tiles together and prevent the edges from displacing relative to each other.

However, this type of tile is not suitable for a retaining wall because the tile's construction is not self-supporting. Each tile is individually fastened to a frame. The edges do not abut each other, but merely overlap. The dovetailed joint between adjoining tiles is required to prevent mating edges from displacing. Without the dovetail, the tiles disclosed in Donaldson would slip and move.

As discussed above, each of the tiles disclosed in Donaldson must be secured to a frame. The tiles are not capable of standing on their own. The perforations for securing the tiles are located in the flanges on the tile's surface. The perforations on the tile's surface compromise the structural integrity of the tile.

U.S. Pat. No. 4,718,792 proposes prefabricated retaining wall elements that provide a process for facing and supporting slopes in a minimum number of operations. This prior art retaining wall is provided as a plurality of prefabricated elements having edges that are designed to connect to neighboring elements. The prefabricated elements are solid, and interconnect with each other, providing a stable support under load or against external forces.

A drawback to this type of prefabricated retaining wall element is that it is necessary to compromise the integrity of the element in order to anchor the element. The element is provided with an insert into which a mechanical extension device is inserted and fixes the panel to the earth underlying the retaining wall.

The insert is a reinforced area having a hole for the ground anchor. The reinforced hole is made directly into the panel. This hole in the flat panel disrupts the integrity of the panel which reduces the overall stability and strength of the entire retaining wall.

In any prior art retaining wall system it is necessary to use temporary bracing to hold the wall in place until the earth is backfilled. This is a time consuming and costly disadvantage that has yet to be overcome with a practical solution until the present invention.

There exists a need for a retaining wall system that will not require jeopardizing the integrity of the elements to anchor them to the earth. There is also a need for simplifying the construction of a retaining wall by eliminating the need for temporary bracing to hold the wall in place until it is completed. The present invention proposes an improved prefabricated cast concrete retaining wall element that overcomes the disadvantages discussed above relating to prior art retaining wall systems.

SUMMARY OF INVENTION

The present invention is a prefabricated concrete retaining wall element which incorporates rearwardly extending legs on a panel. The legs are spaced from each other such that the elements can be stacked in an offset arrangement and the legs of the upper and lower elements will abut. Such an offset arrangement stabilizes the wall and provides reinforcement without added structure that is a requirement for reinforcing prior art retaining walls.

The present invention is capable of producing either a straight or drafted wall. All that is required to produce a drafted wall is to rearrange the positioning of the panel with respect to the ground under the wall.

The legs have holes that can be used for lifting and moving the individual elements. The holes can also be used for attaching mechanical elements that anchor the panel to the earth should the conditions of the soil or the slope require the retaining wall be reinforced and anchored. The holes are in the legs, and not on the panel. Therefore, the integrity of the panel remains structurally sound and is not compromised, improving the overall stability of the wall.

It is an object of the present invention to simplify the construction of a retaining wall by eliminating the need for temporary bracing during construction.

It is another object of the present invention to provide a retaining wall element that is capable of being lifted and anchored while remaining structurally sound without compromising the integrity of the wall.

It is yet another object of the present invention to provide legs on the back of the flat panel that hold the element in place during construction.

It is still another object of the present invention to provide holes in the legs that can be used to lift and anchor the retaining wall element.

It is a further object of the present invention to provide a retaining wall element that can be oriented in either a straight or drafted configuration depending upon the slope.

The invention will be described in detail with reference to the appended drawings. It should be pointed out that the following description is intended to be a description of the preferred embodiment and is not exhaustive or limiting.

BRIEF DESCRIPTION OF THE DRAWINGS

FIG. 5 is a front view of five retaining wall elements of the present invention in an offset panel arrangement; and FIG. 6 is a rear perspective of three retaining wall elements of the present invention in an offset panel arrangement.

DETAILED DESCRIPTION OF THE PREFERRED EMBODIMENT

Figure 1:
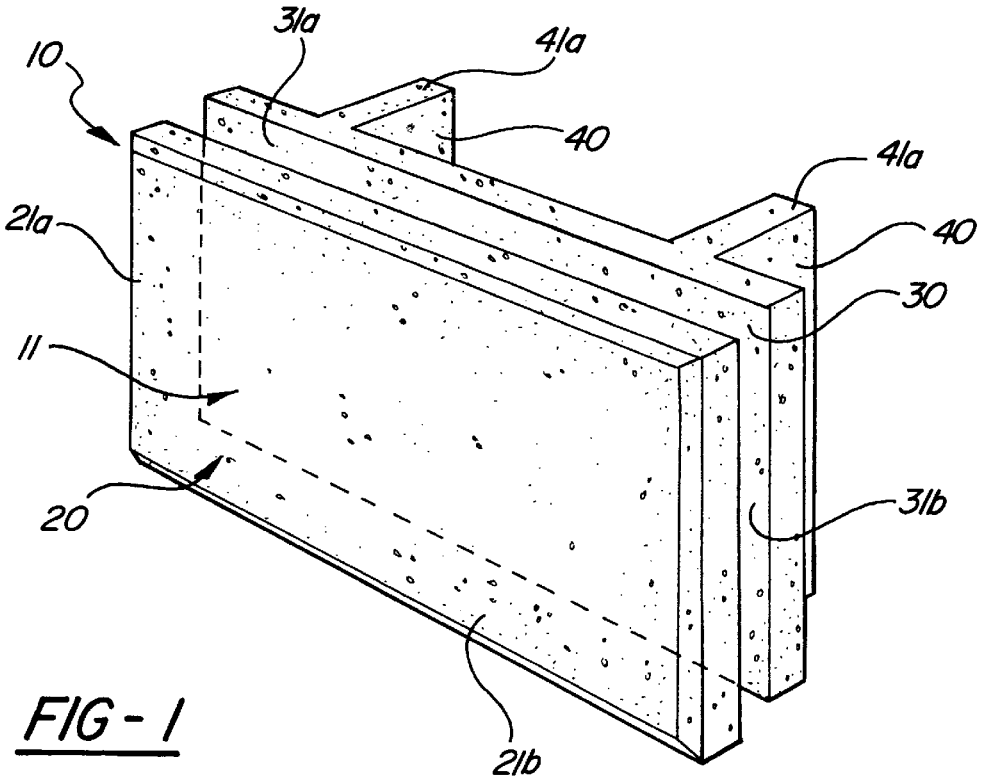
FIG. 1 is a perspective view of the retaining wall element of the present invention.

Referring to FIG. 1, an individual prefabricated element 10 of the present invention is shown. The element can be made of a prefabricated concrete, but any other suitable material and method of manufacture is sufficient.

The element 10 is made of a panel 11 that is preferably flat. The panel 11 has a front face 20, an intermediate face 30, and a rear face 32 . The front face 20 has outwardly projecting flanges 21*a,* 21*b* on two adjacent sides. Likewise, the intermediate face 30 has outwardly projecting flanges 31*a,* 31*b* on two adjacent sides. The outwardly projecting flanges 21*a* and 21*b* of the front face 20 are located on opposite sides from the outwardly projecting flanges 31*a* and 31*b* of the intermediate face 30.

Figure 2:
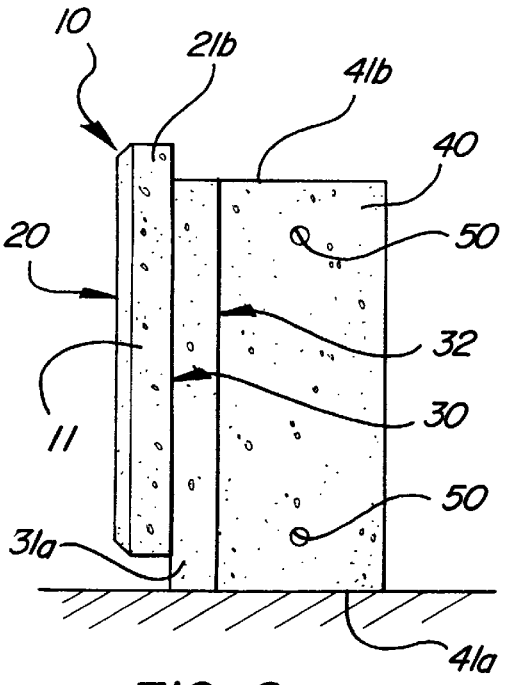
FIG. 2 is a side view of a retaining wall element of the present invention in a straight configuration.

The rear face 32 has at least one rearwardly extending leg 40 which is best shown in FIGS. 1 and 2. The preferred embodiment described herein has two rearwardly extending legs 40, which may be varied with substantially the same results. In the embodiment shown in FIGS. 1 through 3, the rearwardly extending legs 40 run the entire height of the rear face 32. An end surface 41*a* of the rearwardly extending legs 40 is flush with the outwardly extending flange 31*a* of the intermediate face 32.

Placement of the flanges 21*a,* 21*b,* 31*a* , 31*b* relative to the earth locates the element 10 in either a straight or drafted configuration to produce either a straight or drafted wall. FIG. 2 is a side view of a single element 10 in a straight configuration. Note that since the outwardly projecting flange 31*a* is flush with one end surface 41*a* of the rearwardly extending legs 40 a wide flat area supports the element in a perpendicular upright position.

Figure 3:
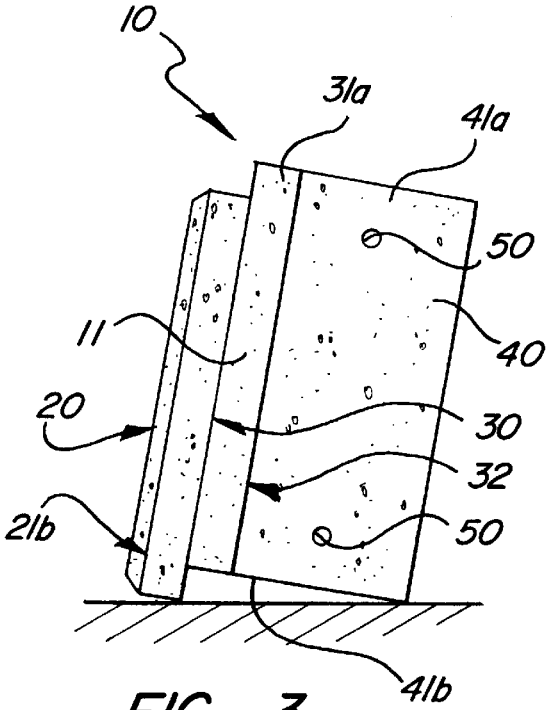
FIG. 3 is a side view of a retaining wall element of the present invention in a drafted configuration.

FIG. 3 is a side view of a single element in a drafted configuration. Here the element is placed on the earth with the outwardly projecting flange 21*b* offset from an opposite end surface 41*b* of the end surface 41*a* which establishes an angle for the retaining wall. The angle of the retaining wall can be varied depending on the distance D that the outwardly projecting flange 21*b* is offset from the opposite end surface 41*b*. The element 10 is capable of standing alone in either configuration without temporary bracing.

In the straight configuration shown in FIG. 2, the end surface 41*a* of the rearwardly extending legs 40 is in contact with the earth. The element 10 is in an upright position, and the entire end surface 41*a* of the rearwardly projecting legs 40 and the outwardly projecting flange 31*a* of the rear face 32 are in contact with the earth.

In the drafted configuration shown in FIG. 3,. the end surface 41*b* of the rearwardly extending legs 40 is at the bottom of the element 10. The outwardly extending flange 21*b* of the front face 20 is in contact with the earth. The rearwardly extending legs 40 are aligned with the height of the rear face 32 and therefore do not reach the outwardly extending flange 21*b* of the front face 20. The element 10 is tilted to rest against the edges of the end surface 41*b* of the rearwardly extending legs 40 in a drafted configuration.

In either arrangement the elements are stacked and nested to the appropriate height to complete the retaining wall. The element 10 is provided with holes 50 in the rearwardly extending legs 40. In the embodiment shown, two holes 50 are spaced from each other in each of the rearwardly extending legs 40. It must be pointed out that the holes 50 are not necessary for the invention to work and are merely conveniences for handling and anchoring the elements 10. In fact, because of the support provided by the rearwardly extending legs 40 it is possible to construct the wall without temporary bracing because the elements 10 are capable of standing alone. Additionally, the added stability makes it possible to avoid the need to anchor the element to the ground in most applications.

In some applications it is desirable to anchor the retaining wall elements 10 to the earth's surface. Bad soil conditions, excessive loading, or extreme height of a wall are examples of situations in which a wall should be anchored to the ground. Should the wall require anchoring, the holes 50 are capable of receiving rods (not shown) for anchoring the element 10 to the ground. Because the holes 50 are located on the rearwardly extending legs 40, they do not compromise the integrity of the individual elements 10 and the result is improved stability of the wall. The location of the holes 50 also makes it convenient to access the anchoring rods simplifying the wall's construction and saving not only time, but money as well.

As is known in the art, a product under the tradename GEO-GRID™ can be used in conjunction with the element 10 of the present invention to anchor the element 10 to the ground. GEO-GRID™ is a plastic that is stretched over a surface area of the earth and creates a webbing. A rod is inserted through the holes 50 in the rearwardly extending legs, and is woven through the webbing, anchoring the element 10 to the earth.

Figure 4:
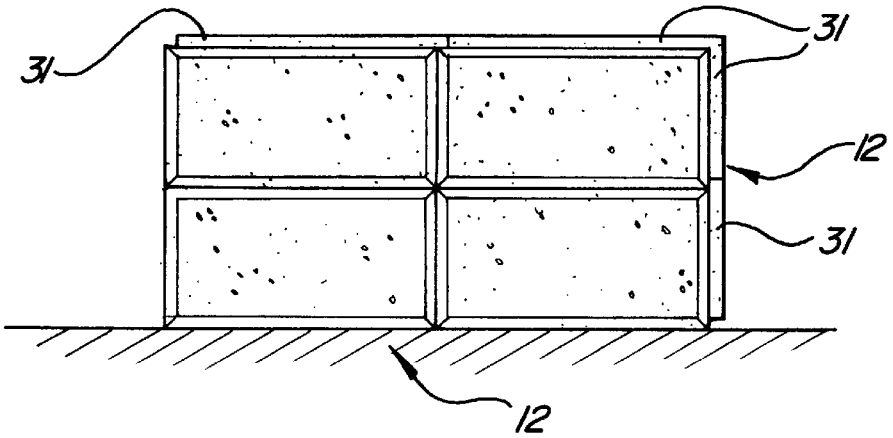
FIG. 4 is a front view of four retaining wall elements interconnected as assembled in a retaining wall having a predetermined draft angle.

The retaining wall 100, shown in partial form in FIGS. 4 through 6, is composed of individual elements 10 abutting each other horizontally and vertically. FIG. 4 shows four elements 10, two elements 10 placed next to each other in a lower row 110, and two elements 10 placed next to each other in an upper row 120.

The outwardly projecting flanges 21*a* and 21*b* of the front face 20 of one element 10 abut the sides of the panel of the other element 10 directly. In other words, the outwardly projecting flanges 21*a* and 21*b* of one element abut the other element on a side of the front face 20 that does not have an outwardly extending flange. Likewise the outwardly extending flanges 31*a* and 31*b* of the intermediate face 30 of one element 10 abut the side of the panel 11 of the other element 10.

The elements 10 are stabilized by the overlapping of the outwardly extending flanges 21*a* and 21*b* of the front face 20 of one element and the outwardly extending flanges 31*a* and 31*b* of the intermediate face 30 ofthe adjacent element. The rearwardly extending legs 40 allow the elements 10 to stand alone. No temporary bracing or reinforcing is required.

Figure 4A:
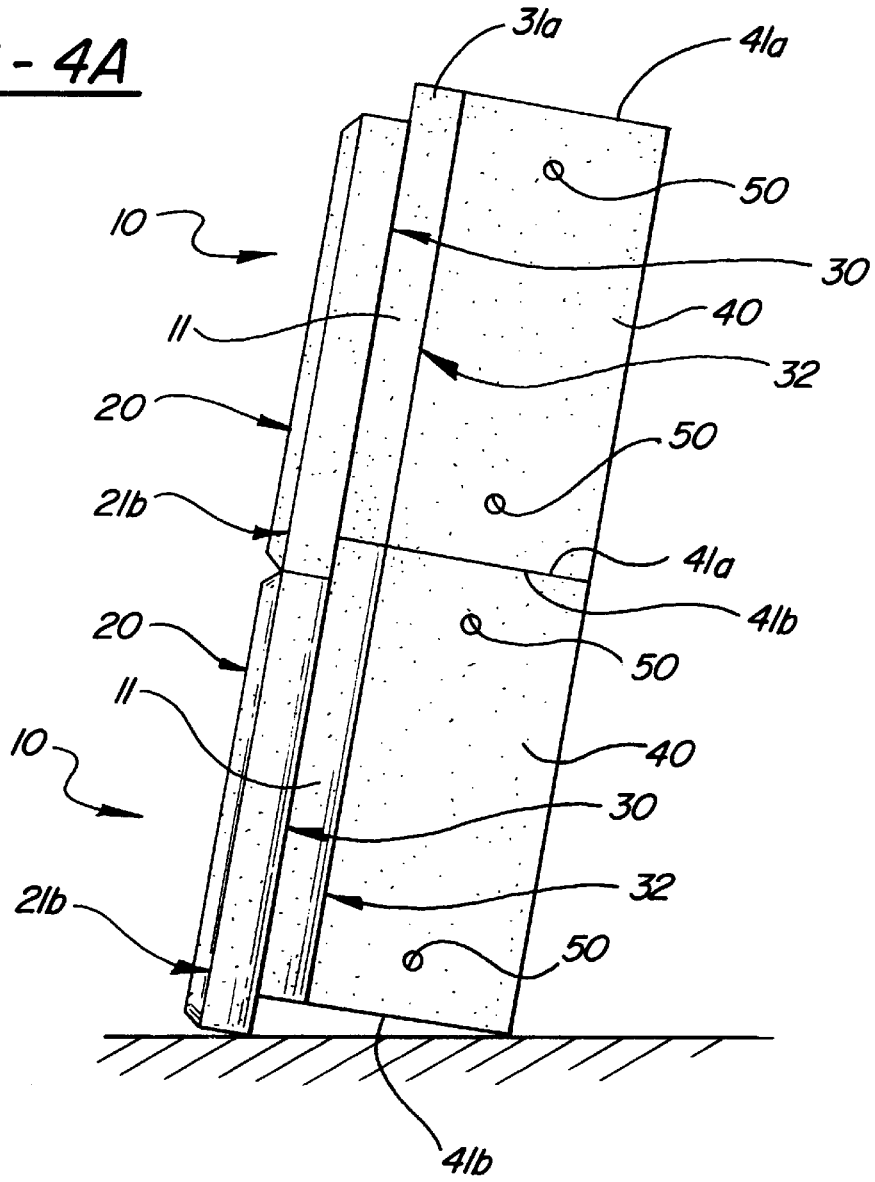
FIG. 4A is a side view of four retaining wall elements depicted in FIG. 4.

In the embodiment shown in FIG. 4, the elements 10 of the lower row 110 and the upper row 120 are aligned with each other. In such an arrangement, both of the rearwardly extending legs 40 of an element 10 of the lower row 110 will contact both of the rearwardly extending legs 40 of an element 10 of the upper row 120. A side view of the embodiment shown in FIG. 4 is illustrated in FIG. 4A.

The elements 10 can also be offset like the wall 200 as shown in FIGS. 5 and 6. In such an arrangement, one of the rearwardly extending legs 40 of an element 10 in a lower row 210 will contact only one of the rearwardly extending legs 40 of an element 10 in an upper row 220. One of the rearwardly projecting legs 40 of an adjacent element 10 in the lower row 210 will contact the other rearwardly extending leg 40 of the element 10 in the upper row 220. The center of the element 10 of the upper row 220 is located above the joint between the two adjacent elements 10 of the lower row 210. The arrangement described above is best shown in FIG. 6.

The wall 200 having offset elements 10 can be either straight or drafted. A straight wall has the elements configured as described above and shown in FIG. 2 wherein the end surface 41*a* of the rearwardly projecting legs 40 is directed at the bottom of the wall. A straight wall is shown in FIG. 6. In a drafted wall the elements 10 are configured in the opposite direction with the end surface 41*a* of the rearwardly projecting legs 40 directed at the top of the wall. A drafted wall is shown in FIG. 4A.

If the land conditions or the specific application requires, the wall can be reinforced and anchored using the holes 50 in the rearwardly extending legs 40. The wall can be anchored to the ground below or behind the elements 10. Also, the individual elements 10 can be reinforced by inserting reinforcing elements (not shown) into the holes 50 and attaching adjacent elements 10 to each other. For example, a metal rod (not shown) can be inserted horizontally along the length of several elements 10 or adjacent elements 10 can be tied vertically to each other using the holes 50 and some type of reinforcing elements (not shown).

A method of constructing a wall using the elements 10 of the present invention includes locating a first element 10. The positioning of the first element 10 will depend upon whether a straight or drafted wall is desired. For a straight wall, the end surface 41*a* of the rearwardly projecting legs 40 will contact the ground below the wall. For a drafted wall, the end surface 41*a* of the rearwardly projecting legs 40 will be directed to the top of the wall. All further elements 10 will have the same positioning as the first element 10. Further elements 10 are placed adjacent the first element 10 until a lower row is completed.

The upper row of elements 10 is located above the elements 10 of the lower row. The placement of the upper row of elements can be aligned as shown in FIG. 4 or offset as shown in FIGS. 5 and 6.

In the wall 100 without offset, the elements 10 of the upper row are directly aligned with the elements 10 of the lower row. Both of the rearwardly projecting legs 40 of the upper row element 10 contact both of the rearwardly projecting legs 40 of the lower row element 10.

In the wall 200 having an offset element arrangement, the elements 10 of the upper row are staggered over the elements 10 of the lower row. The rearwardly extending legs 40 of the upper element contact one rearwardly extending leg 40 of a lower element 10 and one rearwardly extending leg 40 of an adjacent lower element 10.

If the elements are to be anchored to the ground, a further step of attaching anchoring members using the holes 50 will be included. It is possible to anchor each element as it is installed, or any number of elements can be anchored at any time during the construction. The rearwardly extending legs 40 provide the individual elements 10 with the capacity to stand on their own without additional support or reinforcement. This simplifies the construction of the retaining wall While the above describes the preferred embodiment of the present invention, it is to be understood that modifications may be made by one of ordinary skill in the art without departing from the scope of the following claims.

What is claimed is:

1. A modular retaining wall comprising:

a plurality of elements, each of said plurality of elements comprising:

a panel having front, intermediate and rear faces;

an outwardly projecting flange extending along two adjacent sides of said front face;

an outwardly projecting flange extending along two adjacent sides of said intermediate face opposite said outwardly projecting flange of said front face, said intermediate face having an upper and lower end face; and at least one rearwardly projecting leg extending from said rear face for supporting said panel on a surface, said at least one rearwardly projecting leg further comprising:

an upper end surface transverse to said rear face of said panel, said upper end surface being flush with said upper end face of said outwardly projecting flange of said intermediate face of said panel; and an oppositely disposed lower end surface transverse to said rear face of said panel, said lower end surface being flush with said lower end face of said intermediate face of said panel whereby each element of said plurality of elements is positioned with said outwardly projecting flange of said front face contacting a ground surface such that said oppositely disposed lower end face of said rearwardly projecting leg is at an angle to said ground surface thereby locating said plurality of elements at a predetermined angle with respect to said ground surface.

2. A modular retaining wall as claimed in claim 1, wherein said at least one rearwardly projecting leg further comprises an end surface transverse to said rear face of said panel, said end surface located above said outwardly, projecting flange of said front face of said panel, said plurality of elements positioned such that said end surface is at the bottom of said plurality of elements and in contact with said ground surface such that said plurality of elements stand at a predetermined angle to said ground surface.

3. A modular retaining wall as claimed in claim 1, wherein said at least one rearwardly projecting leg further comprises a plurality of rearwardly projecting legs and wherein one of said plurality of rearwardly projecting legs of one element abuts a rearwardly projecting leg of one vertically adjacent element and another rearwardly projecting leg of said one element abuts a rearwardly projecting leg of another vertically adjacent element.

4. A modular retaining wall as claimed in claim 1 further comprising:

at least one transverse opening extending through said at least one rearwardly projecting leg; and means for anchoring said plurality of elements, said means for anchoring located within said transverse opening.

5. A modular retaining wall as claimed in claim 3 further comprising:

at least one transverse opening extending through said at least one rearwardly projecting leg; and means for anchoring said element, said means for anchoring located within said transverse opening.

6. A method of constructing a modular retaining wall system comprising the steps of:

locating a first element of a modular retaining wall, said element comprising:

a panel having front, intermediate and rear faces;

an outwardly projecting flange extending along two adjacent sides of said front face;

an outwardly projecting flange extending along two adjacent sides of said intermediate face opposite said outwardly projecting flange of said front face, said intermediate face having an upper and lower end face; and at least one rearwardly projecting leg extending from said rear face for supporting said panel on a ground surface, said at least one rearwardly projecting leg further comprising:

an upper end surface transverse to said rear face of said panel, said upper end surface being flush with said upper end face of said outwardly projecting flange of said intermediate face of said panel; and an oppositely disposed lower end surface transverse to said rear face of said panel, said lower end surface being flush with said lower end face of said intermediate face of said panel;

positioning said first element with said outwardly projecting flange of said front face contacting the ground surface at an angle such that said oppositely disposed lower end face of said at least one rearwardly projecting leg is at an angle to said ground surface thereby locating said first element at a predetermined angle with respect to said ground surface; and locating at least one other element adjacent said first element, said outwardly projecting flange of said front face of one of said elements abutting a side of the adjacent element opposite said side having said outwardly projecting flange to create said modular retaining wall.

7. A method of constructing a modular retaining wall system as claimed in claim 6 wherein said steps of locating said elements further comprise the steps of locating said elements having more than one rearwardly projecting leg and wherein one of said rearwardly projecting legs of a first element abuts a rearwardly projecting leg of a vertically adjacent element and another rearwardly projecting leg of said first element abuts a rearwardly projecting leg of another vertically adjacent element.

8. A method of constructing a modular retaining wall system as claimed in claim 6, wherein said steps of locating said elements further comprise the steps of:

locating said elements having at least one rearwardly projecting leg with at least one transverse opening therethrough; and anchoring said element using said transverse opening to receive anchoring means.

9. A method of constructing a modular retaining wall system as claimed in claim 7 wherein said steps of locating said element further comprises the steps of:

locating said elements having at least one rearwardly projecting leg with at least one transverse opening therethrough; and anchoring said element using said transverse opening to receive anchoring means.

* * * * *

UNITED STATES PATENT AND TRADEMARK OFFICE

CERTIFICATE OF CORRECTION

PATENT NO. : 5,865,005

DATED : February 2, 1999

INVENTOR(S) : Michael A. Cataldo

It is certified that error appears in the above-identified patent and that said Letters Patent is hereby corrected as shown below:

Column 1, line 7, kindly delete "wall" and insert ----walls;----.

Column 1, line 21, after "example" kindly insert a comma --- , ----.

Column 3, line 65 after "Fig. 3," kindly delete the period " . ".

Column 4, line 61, kindly delete "ofthe" and insert ----of the----.

Column 6, lines 12, 13, 15 and 20, kindly correct indentation to indicate sub-element.

Column 6, lines 24 and 28, kindly correct indentation to indicate a sub sub-element.

Column 7, lines 5, 6,8 and 12, kindly correct indentation to indicate sub-elements.

UNITED STATES PATENT AND TRADEMARK OFFICE

CERTIFICATE OF CORRECTION

PATENT NO. : 5,865,005

DATED : February 2, 1999

INVENTOR(S) : Michael A. Cataldo

It is certified that error appears in the above-identified patent and that said Letters Patent is hereby corrected as shown below:

Column 7, lines 16 and 20, kindly correct indentation to indicate sub sub-elements.

Column 7, lines 25 and 33, kindly correct indentation to indicate element.

Signed and Sealed this

Thirteenth Day of July, 1999

*Attest:*

*Attesting Officer*

Q. TODD DICKINSON

*Acting Commissioner of Patents and Trademarks*